US009476324B2

(12) United States Patent
Hirako et al.

(10) Patent No.: US 9,476,324 B2
(45) Date of Patent: Oct. 25, 2016

(54) EXHAUST COLLECTOR WITH CURVED SIDE PANEL

(71) Applicant: SOLAR TURBINES INCORPORATED, San Diego, CA (US)

(72) Inventors: Kevin Kiyoto Hirako, San Diego, CA (US); Brian Alan Fox, San Marcos, CA (US); Leslie John Faulder, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 524 days.

(21) Appl. No.: 14/031,408

(22) Filed: Sep. 19, 2013

(65) Prior Publication Data

US 2015/0075131 A1 Mar. 19, 2015

(51) Int. Cl.
*F01N 5/00* (2006.01)
*F01D 25/30* (2006.01)

(52) U.S. Cl.
CPC ..... *F01D 25/30* (2013.01); *F05D 2250/713* (2013.01)

(58) Field of Classification Search
CPC .. F01N 5/00; F01N 2470/18; F01N 2490/16; F01N 2530/04; F01N 2590/10; F01D 25/30; F01D 2250/713; F05D 2250/713
USPC ..... 60/39.5; 220/3.2, 4.02, 661, 669, 675
See application file for complete search history.

(56) References Cited

U.S. PATENT DOCUMENTS

| | | | | |
|---|---|---|---|---|
| 3,921,906 | A | 11/1975 | Nye et al. | |
| 4,018,046 | A | 4/1977 | Hurley | |
| 2009/0139221 | A1* | 6/2009 | Farah | F02K 1/822 60/324 |
| 2009/0246010 | A1 | 10/2009 | Roach | |
| 2009/0320496 | A1 | 12/2009 | Faulder et al. | |
| 2011/0236201 | A1* | 9/2011 | Shende | F01D 25/30 415/208.2 |
| 2012/0034064 | A1 | 2/2012 | Nanda et al. | |
| 2012/0063893 | A1 | 3/2012 | Pruthi et al. | |

FOREIGN PATENT DOCUMENTS

JP 2007-255218 10/2007

* cited by examiner

*Primary Examiner* — Ehud Gartenberg
*Assistant Examiner* — Filippo Manfredi
(74) *Attorney, Agent, or Firm* — Procopio, Cory, Hargreaves & Savitch LLP

(57) ABSTRACT

An exhaust collector for a gas turbine engine is disclosed. The exhaust collector includes a front panel, a rear panel, and a side panel. The side panel includes a circumferential portion, a first contoured portion, and a second contoured portion. The circumferential portion extends about the exhaust collector axis with a constant radius. The first contoured portion and the second contoured portion are each between the circumferential portion and the exhaust outlet and include a plurality of curved sections with alternating concavity. Each of the plurality of curved sections extends from the front panel to the rear panel.

16 Claims, 4 Drawing Sheets

EXHAUST COLLECTOR WITH CURVED SIDE PANEL

TECHNICAL FIELD

The present disclosure generally pertains to gas turbine engines, and is more particularly directed toward an exhaust collector with a curved side panel.

BACKGROUND

Gas turbine engines include an inlet, a compressor section, a combustor section, a turbine section, and an exhaust. The exhaust includes an exhaust collector that diffuses exhaust gases and directs the exhaust gases into an exhaust stack system.

U.S. patent application publication No. 2009/0320496 to L. Faulder is directed to an apparatus configured to diffuse a flow of bleed air. The apparatus having an inlet collar configured to receive the flow of bleed air in a direction substantially along a longitudinal axis of the apparatus. The apparatus further having an end wall longitudinally spaced apart from the inlet collar and configured to block the flow of bleed air in a direction substantially along the longitudinal axis. The apparatus also having a first diffuser wall spaced concentrically relative to a second diffuser wall, each of the first and second diffuser walls positioned between the inlet collar and the end wall and including a plurality of perforations configured to permit the flow of bleed air to exit the apparatus at an angle relative to the longitudinal axis.

The present disclosure is directed toward overcoming one or more of the problems discovered by the inventors or that is known in the art.

SUMMARY OF THE DISCLOSURE

An exhaust collector for a gas turbine engine is disclosed. The exhaust collector includes a front panel, a rear panel, and a side panel. The front panel includes a front annular portion. The front annular portion is at least a portion of an annular shape extending about an exhaust collector axis. The rear panel includes a rear annular portion. The rear annular portion is at least a portion of an annular shape extending about the exhaust collector axis, opposite the front panel. The side panel extends between the front panel and the rear panel, forming an exhaust outlet. The exhaust outlet faces in a radial direction. The side panel includes a circumferential portion, a first contoured portion, and a second contoured portion. The circumferential portion extends about the exhaust collector axis with a constant radius. The first contoured portion is between the circumferential portion and the exhaust outlet. The first contoured portion includes a plurality of curved sections with alternating concavity. Each of the plurality of curved sections extends from the front panel to the rear panel. The second contoured portion is between the circumferential portion and the exhaust outlet, opposite the first contoured portion. The second contoured portion includes a second plurality of curved sections with alternating concavity. Each of the second plurality of curved sections extends from the front panel to the rear panel.

DETAILED DESCRIPTION

The systems and methods disclosed herein include an exhaust collector for a gas turbine engine. In embodiments, the exhaust collector includes a front panel, a rear panel, and a side panel. The side panel includes a first contoured portion and a second contoured portion at each side of the exhaust collector. The first contoured portion and the second contoured portion include multiple contours extending across side panel between front panel and rear panel that may increase the stiffness of the side panel, may reduce the deflection and mean stress of the side panel, and may reduce or prevent the possibility of high cycle fatigue failure of the side panel.

Figure 1:
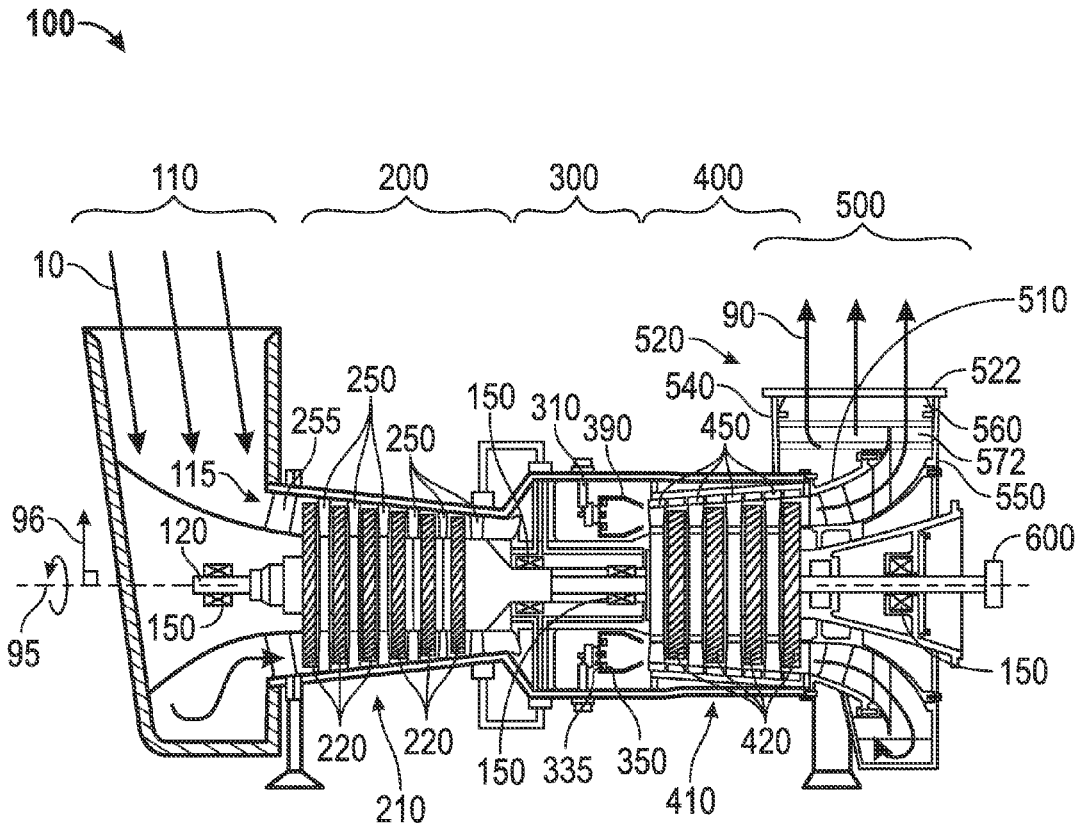
FIG. 1 is a schematic illustration of an exemplary gas turbine engine.

FIG. 1 is a schematic illustration of an exemplary gas turbine engine 100. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a compressor 200, a combustor 300, a turbine 400, an exhaust 500, and a power output coupling 600. The gas turbine engine 100 may have a single shaft or a multiple shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages.

The combustor 300 includes one or more fuel injectors 310 and includes one or more combustion chambers 390. The fuel injectors 310 may be annularly arranged about center axis 95.

The turbine 400 includes a turbine rotor assembly 410 and turbine nozzles 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 510 and an exhaust collector 520. Exhaust collector 520 may connect to exhaust diffuser 510. Exhaust collector 520 may be axially aft and adjacent the turbine 400 and exhaust diffuser 510.

Exhaust collector 520 includes a front panel 540, a rear panel 550, and a side panel 560. Front panel 540 may face in the axial direction of gas turbine engine 100 and may be adjacent turbine 400. Rear panel 550 may also face in the axial direction of gas turbine engine 100 and is the panel opposite front panel 540. Side panel 560 extends between front panel 540 and rear panel 550 along the outer edges of front panel 540 and rear panel 550. Side panel 560 includes a first contoured portion 562 (shown in FIG. 2) and a second contoured portion 572, one on each side of the exhaust collector 520. First contoured portion 562 and second contoured portion 572 may each include multiple curves or contours. Side panel 560 may be manufactured as a single piece or may be manufactured in multiple pieces bonded together by a bonding process such as welding.

Front panel 540, rear panel 550, and side panel 560 may also be bonded together by a bonding process such as welding. Front panel 540, rear panel 550, and side panel 560 may form an exhaust outlet 522. In the embodiment illustrated, exhaust outlet 522 is oriented to expel exhaust gases in vertical direction. In other embodiments, exhaust outlet 522 may be angled alternatively to expel exhaust gases in an alternative position.

Figure 2:
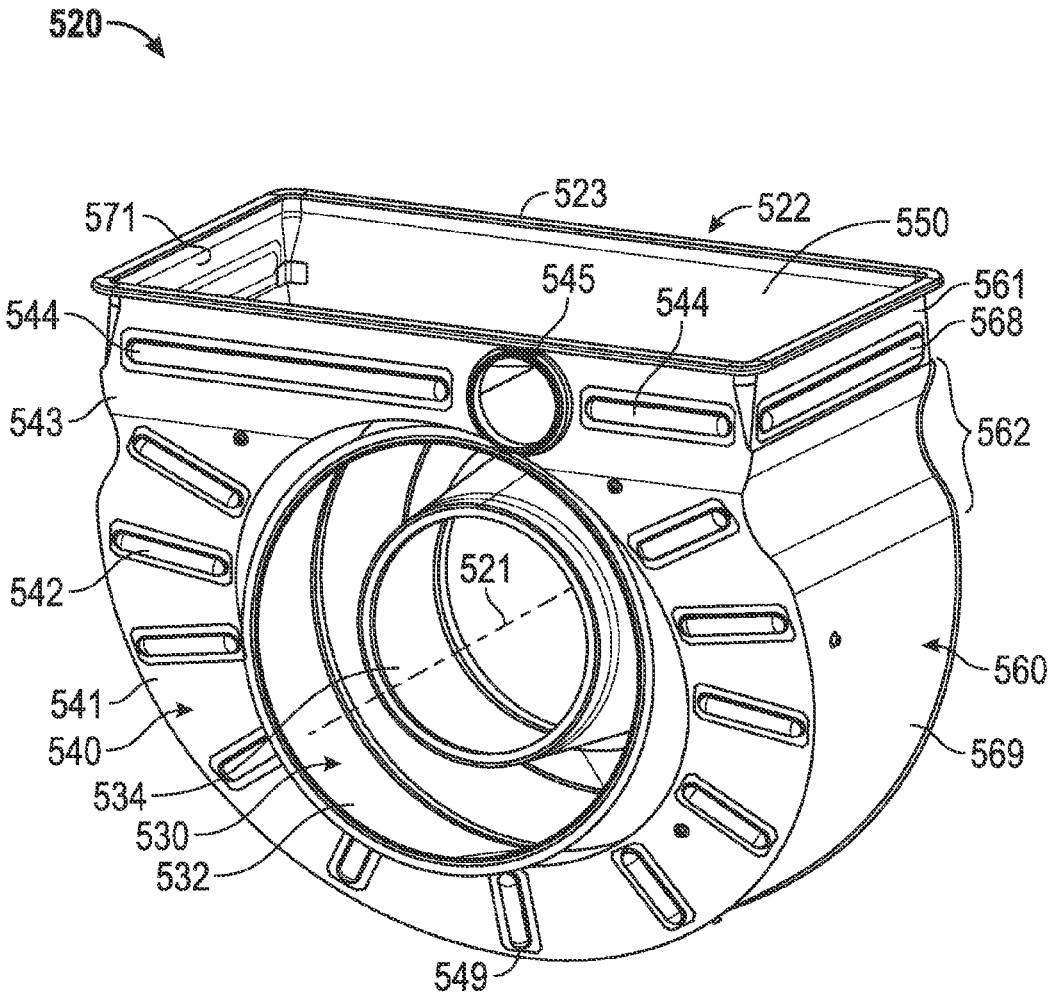
FIG. 2 is a perspective view of the exhaust collector for the gas turbine engine of FIG. 1.

FIG. 2 is a perspective view of the exhaust collector 520 for the gas turbine engine 100 of FIG. 1. Exhaust collector 520 may include an exhaust collector axis 521. The exhaust collector axis 521 may be coaxial to or aligned with center axis 95 (shown in FIG. 1). In the embodiment illustrated in FIG. 2, front panel 540 includes a front annular portion 541 and a front upper portion 543. Front annular portion 541 may include all or a portion of an annular ring shape. The portion of the annular ring shape may include an annular segment that includes at least one-hundred and eighty degrees of the annulus. The annular ring shape extends about exhaust collector axis 521.

Front upper portion 543 may include a rectangular shape extending from front annular portion 541. Front upper portion 543 may extend from the front annular portion 541 where the chord cuts the annulus to form the annular segment shape. Front upper portion 543 may form one of the sides or a portion of exhaust outlet 522. Front annular portion 541 may be angled such that a point 549 distal to or located opposite front upper portion 543 is closer to rear panel 550 in the axial direction than front upper portion 543.

Front panel 540 may also include a bleed air flange 545. Bleed air flange 545 may be located within the edges of front upper portion 543 and may extend out from front upper portion 543 with a hollow cylinder shape forming a bleed air inlet into the exhaust collector 520.

Exhaust collector 520 may include front radial stiffeners 542 and front upper stiffeners 544. Front radial stiffeners 542 may extend in the radial direction relative to exhaust collector axis 521 along the outer surface of front annular portion 541. Front upper stiffeners 544 may extend between side panel 560 and bleed air flange 545 along front upper portion 543.

Exhaust collector 520 also includes exhaust inlet 530. Exhaust inlet 530 is configured to receive exhaust gases traveling in the axial direction or substantially in the axial direction from the turbine section 400 of gas turbine engine 100. Exhaust inlet 530 may include an outer wall 532 and an inner wall 534. Outer wall 532 may be a hollow cylinder and may be located adjacent the inner radius defining the annular shape of front annular portion 541. Outer wall 532 may partially protrude axially forward of front annular portion 541 and extends axially from front annular portion 541 towards rear annular portion 551.

Inner wall 534 is located radially inward of outer wall 532. Inner wall 534 may be a hollow cylinder and extends and connects to rear panel 550. Outer wall 532 and inner wall 534 may be configured to connect or couple to exhaust diffuser 510.

Exhaust outlet 522 may be a rectangular opening in exhaust collector 520 oriented perpendicular to a radial extending from exhaust collector axis 521 and facing in the radial direction.

Side panel 560 extends from one side of exhaust outlet 522, around exhaust collector axis 521, and to the other side of exhaust outlet 522. Side panel 560 may include circumferential portion 569, first side portion 561, and second side portion 571. Circumferential portion 569 may be a segment or a sector of a hollow cylinder or cylindrical shell revolved about exhaust collector axis 521. Circumferential portion 569 may revolve at least one-hundred and eighty degrees about exhaust collector axis 521 with a constant radius. Circumferential portion 569 is situated opposite exhaust outlet 522.

First side portion 561 may be perpendicular to front upper portion 543, extending in the axial direction of exhaust collector axis 521. First side portion 561 may form another side or portion of exhaust outlet 522. Exhaust collector 520 may also include first side stiffener 568 extending in the axial direction along the outer surface of first side portion 561.

Second side portion 571 may also be perpendicular to front upper portion 543, extending in the axial direction of exhaust collector axis 521. Second side portion 571 is located opposite first side portion 561 and may be parallel to first side portion 561. Second side portion 571 may form another side or portion of exhaust outlet 522. Exhaust collector 520 may also include a second side stiffener 578 (shown in FIGS. 4 and 5) extending in the axial direction along the outer surface of second side portion 571.

First contoured portion 562 is located between circumferential portion 569 and exhaust outlet 522. In the embodiment illustrated, first contoured portion 562 extends between circumferential portion 569 and first side portion 561, spanning from front panel 540 to rear panel 550. First contoured portion 562 includes multiple contoured sections with alternating concavity between circumferential portion 569 and exhaust outlet 522. Each contoured section and the line of inflection between contoured sections extend from front panel 540 to rear panel 550.

Figure 3:
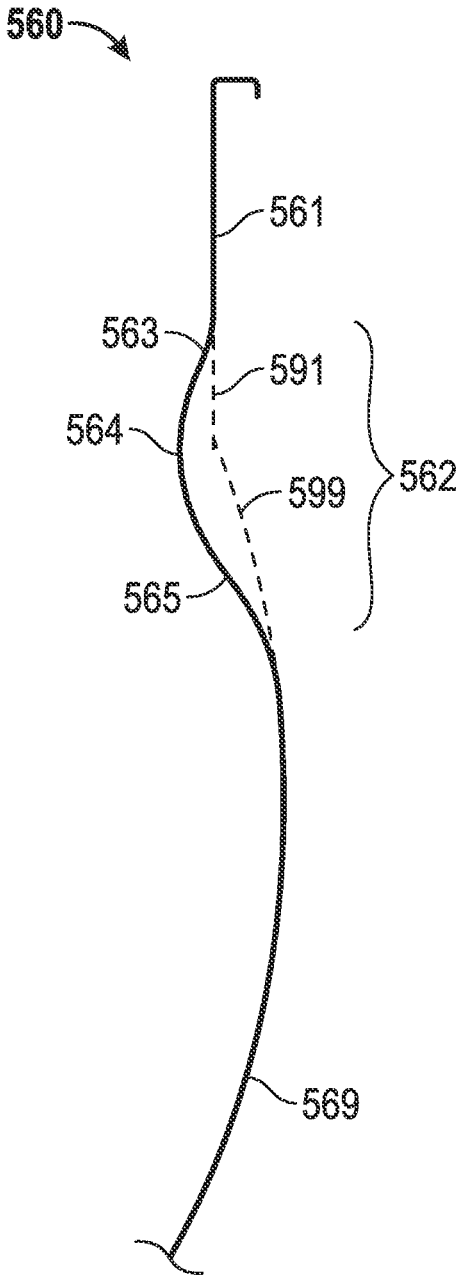
FIG. 3 is view of a portion of the profile of the side panel for the exhaust collector of FIG. 2.

FIG. 3 is view of a portion of the profile of the side panel 560 for the exhaust collector 520 of FIG. 2. In the embodiment illustrated in FIG. 3, first contoured portion 562 includes first contour 563, second contour 564, and third contour 565. First contour 563 may be adjacent first side portion 561 and may be between first side portion 561 and second contour 564 and may curve from first side portion 561 to second contour 564. Second contour 564 may be between first contour 563 and third contour 565 and may curve from first contour 563 to third contour 565. Third contour 565 may be adjacent circumferential portion 569, may be between circumferential portion 569 and second contour 564, and may curve from circumferential portion 569 to second contour 564. First contour 563, second contour 564, and third contour 565 may each be a uniformly curved panel or section with a constant radius, each panel or section spanning across side panel 560 and extending from front panel 540 to rear panel 550.

The profiles of first contour 563, second contour 564, and third contour 565 may each be an arc with a radius from 127 millimeters (5 inches) to 381 millimeters (15 inches) or may each be an arc with a radius from one-tenth of the radius of circumferential portion 569 to three-tenths of the radius of circumferential portion 569. In one embodiment, the profiles of first contour 563, second contour 564, and third contour 565 are each an arc with a radius from 228.6 millimeters (9 inches) to 279.4 millimeters (11 inches). In another embodiment, the radii for the profiles of first contour 563, second contour 564, and third contour 565 are equal, for example 254 millimeters (10 inches) or one-fifth of the radius of circumferential portion 569.

The curvature for the profile of first contoured portion 562 may form a spline with multiple curves or arcs with alternating concavity. In one embodiment, first contour 563 and third contour 565 are curves with a concave shape, and second contour 564 is a curve with a convex shape. In another embodiment, first contour 563 and third contour 565 are curves with a convex shape, and second contour 564 is a curve with a concave shape.

The first contoured portion 562 may form an undercut or a recess relative to circumferential portion 569 and first side portion 561. Dashed lines 591 and 599 illustrate this undercut or recess by showing where the intersection between circumferential portion 569 and side portion 561 would occur without first contoured portion 562. First contour 563 and third contour 565 each curve inward from side portion 561 and circumferential portion 569 respectively to create the undercut or recess.

The height of first contoured portion 562 may be from 508 millimeters (20 inches) to 584.2 millimeters (23 inches) or may be between two-thirds and three-quarters the combined amount of the radii defining the contoured portion 562, such as the radii of first contour 563, second contour 564, and third contour 565. The height being in the radial direction that the exhaust gases flow out of exhaust collector 520. In the embodiment illustrated, the exhaust gases flow out of exhaust collector 520 in the vertical direction.

Figure 4:
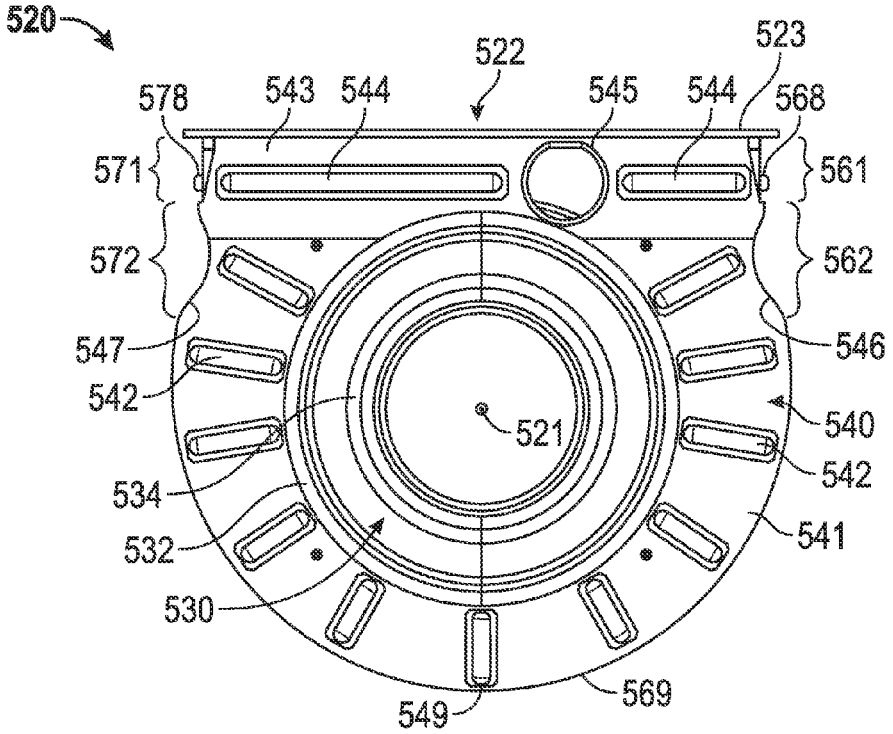
FIG. 4 is a front view of the exhaust collector of FIG. 2.

FIG. 4 is a front view of the exhaust collector 520 of FIG. 2. Second contoured portion 572 includes the same or similar contours, radii, and height as those described for first contoured portion 562. Similar to first contoured portion 562, second contoured portion 572 is located between circumferential portion 569 and exhaust outlet 522. In the embodiment illustrated, second contoured portion 572 extends between circumferential portion 569 and second side portion 571. The second contoured portion 572 may form an undercut or a recess relative to circumferential portion 569 and second side portion 571, in the same or a similar manner as first contoured portion 562 may form an undercut or recess relative to circumferential portion 569 and first side portion 561.

Referring to FIG. 4, front panel 540 includes a first front contour 546 and a second front contour 547. First front contour 546 aligns with first contoured portion 562. First front contour 546 includes the same spline or curves as first contoured portion 562. First front contour 546 is located along the outer edge of front panel 540 and may be located at the transition between front annular portion 541 and front upper portion 543. Similarly, second front contour 547 aligns with second contoured portion 572. Second front contour 547 includes the same spline or curves as second contoured portion 572. Second front contour 547 is located along the outer edge of front panel 540 and may be located at the transition between front annular portion 541 and front upper portion 543, opposite first front contour 546.

Figure 5:
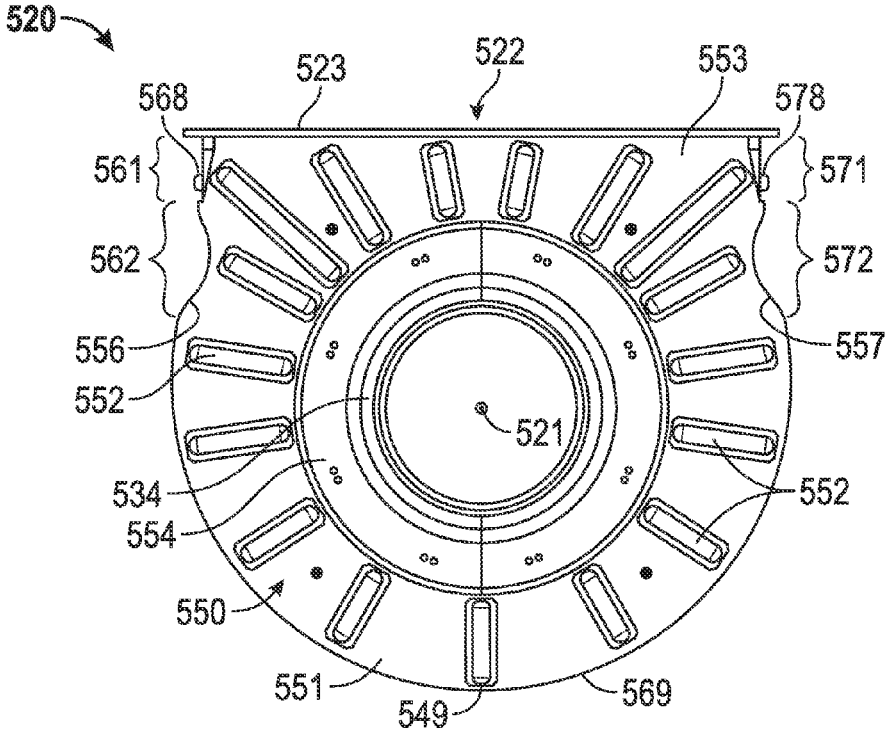
FIG. 5 is a rear view of the exhaust collector of FIG. 2.

FIG. 5 is a rear view of the exhaust collector 520 of FIG. 2. Rear panel 550 includes rear annular portion 551, rear upper portion 553, rear conical portion 554, first rear contour 556 and second rear contour 557.

Rear annular portion 551 may include all or a portion of an annular ring shape. The portion of the annular ring shape may include an annular segment that includes at least one-hundred and eighty degrees of the annulus. The annular ring shape extends about exhaust collector axis 521.

Rear upper portion 553 may include a rectangular shape extending from rear annular portion 551. Rear upper portion 553 may extend from the rear annular portion 551 where the chord cuts the annulus to form the annular segment shape. Rear upper portion 553 may form one of the sides or a portion of exhaust outlet 522. The edges of front upper portion 543, rear upper portion 553, first side portion 561, and second side portion 571 located at exhaust outlet 522 may form outlet flange 523. Outer flange 523 may be used to couple exhaust collector 520 to an exhaust stack system (not shown).

Rear conical portion 554 may extend radially inward and axially towards front panel 540 from rear annular portion 551 to inner wall 534 of exhaust inlet 530. Rear conical portion 554 may include the shape of a frustum of a hollow cone, hyperbolic funnel, or pseudosphere. Inner wall 534 may continue the shape of rear conical portion 554 as inner wall 534 extends axially towards exhaust diffuser 510.

First rear contour 556 aligns with first contoured portion 562. First rear contour 556 includes the same spline or curves as first contoured portion 562. First rear contour 556 is located along the outer edge of rear panel 550 and may be located at the transition between rear annular portion 551 and rear upper portion 553. Similarly, second rear contour 557 aligns with second contoured portion 572. Second rear contour 557 includes the same spline or curves as second contoured portion 572. Second rear contour 557 is located along the outer edge of rear panel 550 and may be located at the transition between rear annular portion 551 and rear upper portion 553, opposite first rear contour 556.

Exhaust collector 520 may include rear stiffeners 552. Rear stiffeners 552 may extend in the radial direction relative to exhaust collector axis 521 along the outer surface of rear annular portion 551. Each stiffener of exhaust collector 520 including front radial stiffeners 542, front upper stiffeners 544, rear stiffeners 552, first side stiffener 568, and second side stiffener 578 may include an area moment of inertia from 4.787 $cm^4$ (0.115 $in.^4$) to 6.035 $cm^4$ (0.145 $in.^4$). Each stiffener may include an elongated rectangular plate with a hollow protruded portion. The hollow protruded portion may include a curve with a concave shape such as a portion of a hollow cylinder with a portion of a spherical shell capping each end. The portion of the hollow cylinder may be a cylindrical segment where the plane cutting the hollow cylinder extends in the axial direction of the cylinder. In one embodiment, the cross-section of the protruded portion includes a radius and a height from 30.48 millimeters (1.2 inches) to 33.02 millimeters (1.3 inches). In another embodiment the radius and height of the cross-section of the protruded portion are 31.75 millimeters (1.25 inches).

Front panel 540, rear panel 550, and side panel 560 may be thicker than other parts of exhaust collector 520 such as outer wall 532 and inner wall 534 of exhaust inlet 530, and the stiffeners. In one embodiment, front panel 540, rear panel 550, and side panel 560 are from 2.794 millimeters (0.110 inches) to 3.302 millimeters (0.130 inches) thick. In another embodiment, front panel 540, rear panel 550, and side panel 560 are 3.048 millimeters (0.120 inches) thick.

In embodiments, outer wall 532, inner wall 534, and the stiffeners are from 2.159 millimeters (0.085 inches) to 2.413 millimeters (0.095 inches). While in other embodiments, outer wall 532, inner wall 534, and the stiffeners are 2.286 millimeters (0.090 inches).

One or more of the above components (or their subcomponents) may be made from sheet metal, stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, alloy x, INCONEL, WASPALOY, RENE alloys, HAYNES alloys, alloy 188, alloy 230, INCOLOY, MP98T, TMS alloys, and CMSX single crystal alloys. In the embodiments illustrated, the exhaust collector 520 is formed with sheet metal with the shapes and thicknesses disclosed herein welded together.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 390 via fuel injector 310 and ignited. After the combustion reaction, energy is then extracted from the combusted fuel/air mixture via the turbine 400 by each stage of the series of turbine disk assemblies 420.

Exhaust gas 90 may then be diffused in exhaust diffuser 510 and directed into exhaust collector 520. Exhaust collector 520 redirects the exhaust gas 90 from an axial direction at the exhaust inlet 530 to a radial direction at the exhaust outlet 522. Exhaust collector 520 may direct the exhaust gas 90 into an exhaust stack system to vent the exhaust gas 90 to atmosphere. The exhaust stack system may further process the exhaust gas 90 to reduce harmful emissions, and/or to recover heat from the exhaust gas 90 prior to venting the exhaust gas 90 to atmosphere.

During operation of gas turbine engine 100, exhaust collector 520 may be subjected to high stresses due to internal back pressure and natural frequency excitation. Large flat areas of an exhaust collector 520 may be susceptible to deformation and high cycle fatigue failure due to the high stresses. The high cycle fatigue failure may result in cracks and the escape of hot exhaust gases.

The first contoured portion 562 and second contoured portion 572 are configured with a stiffness and a resonant frequency to minimize natural frequency excitation and high cycle fatigue of each side of the side panel 560 between the exhaust outlet 522 and circumferential portion 569. The curvature of first contoured portion 562 and second contoured portion 572 may reduce the deflection of side panel 560 and may reduce the mean stress of side panel 560. The curvature of first contoured portion 562 and second contoured portion 572 may also increase the stiffness of side panel 560, which may reduce alternating stresses and may increase the natural frequency of side panel 560. Increasing the natural frequency of side panel 560 may make modal excitation more difficult.

The increased stiffness due to the curvature of first contoured portion 562 and second contoured portion 572 may reduce or prevent the possibility of high cycle fatigue failures, which may improve the reliability of exhaust collector 520 and may prevent downtime of gas turbine engine 100.

Thickening front panel 540, rear panel 550, and side panel 560 may also increase the stiffness of exhaust collector 520. Further, increasing the radii of the stiffeners, such as first side stiffener 568 and second side stiffener 578, may increase the area moment of inertia of the stiffeners, further increasing the stiffness of exhaust collector 520.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular gas turbine engine, it will be appreciated that the exhaust collector in accordance with this disclosure can be implemented in various other configurations, can be used with various other types of gas turbine engines, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. An exhaust collector for a gas turbine engine, the exhaust collector comprising:

a front panel including a front annular portion, the front annular portion being at least a portion of an annular shape extending about an exhaust collector axis;

a rear panel including a rear annular portion, the rear annular portion being at least a portion of an annular shape extending about the exhaust collector axis, opposite the front panel; and a side panel extending between the front panel and the rear panel forming an exhaust outlet, the exhaust outlet facing in a radial direction, the side panel including a circumferential portion extending about the exhaust collector axis with a constant radius, a first contoured portion between the circumferential portion and the exhaust outlet, the first contoured portion including a plurality of curved sections with alternating concavity, each of the plurality of curved sections extending from the front panel to the rear panel, and a second contoured portion between the circumferential portion and the exhaust outlet, opposite the first contoured portion, the second contoured portion including a second plurality of curved sections with alternating concavity, each of the second plurality of curved sections extending from the front panel to the rear panel, wherein the plurality of curved sections and the second plurality of second curved sections each include a first contour, a second contour, and a third contour, wherein each first contour includes a curve with a constant radius and a concave shape, each second contour includes a curve with a constant radius and a convex shape, each third contour includes a curve with a constant radius and a concave shape extending from the second contour to the circumferential portion.

2. The exhaust collector of claim 1, wherein each of the plurality of curved sections and the second plurality of curved sections includes a radius from one-tenth of the radius of the circumferential portion to three-tenths of the radius of the circumferential portion.

3. The exhaust collector of claim 1, wherein the first contour, the second contour, and the third contour each include a radius from 127 millimeters to 381 millimeters.

4. The exhaust collector of claim 1, wherein the first contour, the second contour, and the third contour each include a radius from 228.6 millimeters to 279.4 millimeters.

5. The exhaust collector of claim 1, wherein the first contoured portion and the second contoured portion are configured with a stiffness and a resonant frequency to minimize natural frequency excitation and high cycle fatigue of the side panel.

6. The exhaust collector of claim 1, further comprising:

a first side stiffener extending axially along a surface of the side panel adjacent the first contoured portion, the first side stiffener including an area moment of inertia from 4.787 $cm^4$ to 6.035 $cm^4$, and a second side stiffener extending axially along the surface of the side panel adjacent the second contoured portion, the second side stiffener including an area moment of inertia from 4.787 $cm^4$ to 6.035 $cm^4$.

7. The exhaust collector of claim 1, wherein the front panel, the rear panel, and the side panel are each sheet metal from 2.794 millimeters to 3.302 millimeters thick.

8. The gas turbine engine including a turbine section and the exhaust collector of claim 1, wherein the front panel is adjacent the turbine section.

9. An exhaust collector for a gas turbine engine, the exhaust collector comprising:

a front panel including a front annular portion, the front annular portion being at least a segment of an annulus extending at least one-hundred and eighty degrees about an exhaust collector axis, and a front upper portion extending from the front annular portion where a chord cuts the annulus to form the shape of the front annular portion, the front upper portion including a rectangular shape;

a rear panel including a rear annular portion, the rear annular portion being at least a segment of an annulus extending at least one-hundred and eighty degrees about the exhaust collector axis, opposite the front annular portion, and a rear upper portion extending from the rear annular portion where a chord cuts the annulus to form the shape of the rear annular portion, the rear upper portion including a rectangular shape parallel to the front upper portion; and a side panel extending between outer edges of the front panel and the rear panel, the side panel including a circumferential portion extending about the exhaust collector axis with a constant radius between the front annular portion and the rear annular portion, a first side portion extending from the front upper portion to the rear upper portion and perpendicular to the front upper portion and the rear upper portion, a second side portion extending from the front upper portion to the rear upper portion, perpendicular to the front upper portion and the rear upper portion, and parallel to the first side portion, the front upper portion, the rear upper portion, the first side portion, and the second side portion forming an exhaust outlet, a first contoured portion including a first profile with a spline extending between the circumferential portion and the first side portion with radii from 127 millimeters to 381 millimeters, the first contoured portion spanning from the front panel to the rear panel, and a second contoured portion including a second profile with a spline extending between the circumferential portion and the second portion with radii from 127 millimeters to 381 millimeters, the second contoured portion spanning from the front panel to the rear panel, wherein the first contoured portion and the second contoured portion each include a first contour, a second contour, and a third contour, wherein each first contour includes a curve with a constant radius and a concave shape extending from the first side portion to the second contour, each second contour includes a curve with a constant radius and a convex shape extending from the first contour to the third contour, and each third contour includes a curve with a constant radius and a concave shape extending from the second contour to the circumferential portion.

10. The exhaust collector of claim 9, wherein each spline of the first contoured portion and the second contoured portion include curves with radii from 228.6 millimeters to 279.4 millimeters.

11. The exhaust collector of claim 9, further comprising:

a first side stiffener extending in an axial direction along a first surface of the first side portion, the first side stiffener including an area moment of inertia from 4.787 $cm^4$ to 6.035 $cm^4$, and a second side stiffener extending in the axial direction along a second surface of the second side portion, the second side stiffener including an area moment of inertia from 4.787 $cm^4$ to 6.035 $cm^4$.

12. The exhaust collector of claim 9, wherein the first contoured portion forms a recess between the first side portion and the circumferential portion and the second contoured portion forms a recess between the second side portion and the circumferential portion.

13. The gas turbine engine including a turbine section and the exhaust collector of claim 9, wherein the front panel is adjacent the turbine section.

14. An exhaust collector for a gas turbine engine, the exhaust collector comprising:

an exhaust inlet configured to receive exhaust from the gas turbine engine;

an exhaust outlet configured to direct exhaust from the gas turbine engine in a radial direction relative to an exhaust collector axis, the exhaust outlet being oriented perpendicular to a radial extending from the exhaust collector axis;

a front panel facing in an axial direction of the exhaust collector axis;

a rear panel facing in the axial direction of the exhaust collector axis and spaced apart from the front panel; and a side panel extending from one side of the exhaust outlet, around the exhaust collector axis, and to the other side of the exhaust outlet, and extending between the front panel and the rear panel, the side panel including a circumferential portion revolved at least one-hundred and eighty degrees about the exhaust collector axis with a constant radius and situated opposite the exhaust outlet, a first contoured portion located between the circumferential portion and the exhaust outlet, the first contoured portion including a first plurality of curved sections extending from the front panel to the rear panel, a second contoured portion located between the circumferential portion and the exhaust outlet and located opposite the first contoured portion, the second contoured portion including a second plurality of curved sections extending from the front panel to the rear panel, the first contoured portion and the second contoured portion are each configured with a stiffness and a resonant frequency to minimize natural frequency excitation and high cycle fatigue of the side panel between the circumferential portion and the exhaust outlet, wherein the first plurality of curved sections and the second plurality of curved sections each include a first contour, a second contour, and a third contour with radii from one-tenth of the radius of the circumferential portion to three-tenths of the radius of the circumferential portion, and wherein the first contour is adjacent the second contour and is between the exhaust outlet and the second contour, the second contour is adjacent and between the first contour and the third contour, and the third contour is adjacent and between the circumferential portion and the second contour.

15. The exhaust collector of claim 14, wherein the first contour, the second contour, and the third contour each include a radius from 228.6 millimeters to 279.4 millimeters.

16. The exhaust collector of claim 14, wherein the front panel, the rear panel, and the side panel are each sheet metal from 2.794 millimeters to 3.302 millimeters thick.

* * * * *